US010085530B2

(12) United States Patent
Blasbichler et al.

(10) Patent No.: US 10,085,530 B2
(45) Date of Patent: Oct. 2, 2018

(54) CHATON CUT FOR A GEMSTONE MADE OF TOPAZ

(71) Applicant: D. Swarovski KG, Wattens (AT)

(72) Inventors: Guenther Blasbichler, Innsbruck (AT); Christian Loinger, Innsbruck (AT)

(73) Assignee: D. Swarovski KG, Wattens (AT)

( * ) Notice: Subject to any disclaimer, the term of this patent is extended or adjusted under 35 U.S.C. 154(b) by 0 days.

(21) Appl. No.: 14/675,867

(22) Filed: Apr. 1, 2015

(65) Prior Publication Data

US 2015/0201720 A1 Jul. 23, 2015

Related U.S. Application Data

(63) Continuation of application No. PCT/AT2013/000165, filed on Oct. 9, 2013.

(30) Foreign Application Priority Data

Oct. 12, 2012 (AT) ..... A 1108/2012

(51) Int. Cl.
*A44C 17/00* (2006.01)

(52) U.S. Cl.
CPC ..... *A44C 17/00* (2013.01); *A44C 17/001* (2013.01)

(58) Field of Classification Search
CPC ..... A44C 17/00; A44C 17/001
USPC ..... 63/32; D11/90
See application file for complete search history.

(56) References Cited

U.S. PATENT DOCUMENTS

| | | | | | |
|---|---|---|---|---|---|
| D36,167 | S | * | 12/1902 | Schenck | 63/32 |
| 3,585,764 | A | * | 6/1971 | Huisman | A44C 17/001 125/30.01 |
| 4,306,427 | A | * | 12/1981 | Urban | A44C 17/001 63/32 |
| D434,690 | S | * | 12/2000 | Vered | D11/90 |
| D460,711 | S | * | 7/2002 | Cohen | D11/90 |
| D476,257 | S | * | 6/2003 | Mehta | D11/90 |
| 6,615,611 | B1 | | 9/2003 | Schachter et al. | |

(Continued)

FOREIGN PATENT DOCUMENTS

| | | |
|---|---|---|
| EP | 2 436 281 | 4/2012 |
| EP | 2 505 0096 | 10/2012 |

(Continued)

OTHER PUBLICATIONS

International Search Report dated Jan. 24, 2014 in International (PCT) Application No. PCT/AT2013/000165 with English translation.

(Continued)

*Primary Examiner* — Emily M Morgan
(74) *Attorney, Agent, or Firm* — Stevens & Showalter, LLP

(57) ABSTRACT

A gemstone has a chaton cut, in which a crown adjoins a flat table and has facets that are inclined downwardly relative to the table all the way round, wherein the crown has main facets that extend substantially from the table as far as a girdle at which the gemstone has the largest transverse dimension. A pavilion of facets, preferably facets converging to a point, adjoins below the girdle. The gemstone consists preferably entirely of topaz, and the angle of the main facets relative to a cross-sectional face arranged parallel to the table is between 32.5° and 34.5°.

36 Claims, 6 Drawing Sheets

(56) References Cited

U.S. PATENT DOCUMENTS

Figure 1A:
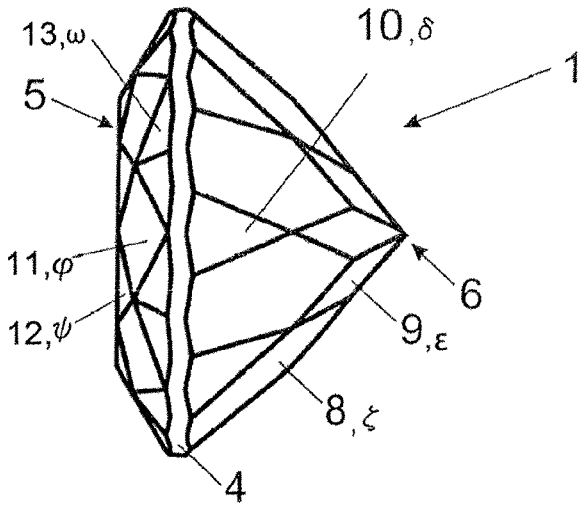

D504,347 S * 4/2005 Yuan ..... D11/90
D536,634 S * 2/2007 Cornfield ..... D11/90
D566,608 S * 4/2008 Sinclaire ..... D11/90
D566,611 S * 4/2008 Sinclaire ..... D11/90
D567,136 S * 4/2008 Sinclaire ..... D11/90
D632,205 S * 2/2011 Mehta ..... D11/90
D650,306 S * 12/2011 Siman-Tov ..... D11/90
D656,060 S * 3/2012 Cheng ..... D11/90
D656,063 S * 3/2012 Botha ..... D11/90
2002/0162356 A1* 11/2002 Wueste ..... A44C 17/001 63/32
2003/0181147 A1 9/2003 Schachter et al.
2003/0188551 A1 10/2003 Schachter et al.
2003/0221451 A1* 12/2003 Steiner ..... A44C 17/02 63/26
2005/0050921 A1* 3/2005 Katz ..... A44C 17/001 63/32
2006/0026991 A1* 2/2006 Shuto ..... A44C 17/001 63/32
2006/0124119 A1* 6/2006 Shuto ..... A44C 17/001 125/30.01
2007/0186586 A1* 8/2007 Matsumura ..... A44C 17/001 63/32
2008/0271488 A1* 11/2008 Rydlewicz ..... A44C 17/001 63/32
2009/0056374 A1* 3/2009 Abate ..... A44C 17/001 63/26
2010/0154473 A1 6/2010 Xheng
2010/0242540 A1* 9/2010 Swarovski ..... A44C 17/008 63/26
2011/0016918 A1* 1/2011 Matsumura ..... A44C 17/001 63/32
2012/0079853 A1 4/2012 Blasbichler et al.
2012/0096898 A1* 4/2012 van Looveren ..... A44C 17/001 63/32
2012/0227444 A1* 9/2012 Froehlich ..... A44C 17/007 63/32

FOREIGN PATENT DOCUMENTS

JP 2003-210221 7/2003
JP 3172656 12/2011

OTHER PUBLICATIONS

Austrian Search Report dated Aug. 27, 2013 in Austrian Patent Application No. A 1108/2012 with English translation.
European Office Action (partly in English) dated Jan. 4, 2016 in counterpart European Application No. 13 795 402.
English translation of Chinese Search Report (SR) dated Jul. 28, 2016 in related Chinese Patent Application No. 201380060726.8.

* cited by examiner

CHATON CUT FOR A GEMSTONE MADE OF TOPAZ

The invention concerns a gemstone having a chaton cut in which there adjoins a flat table, a crown which has facets that fall away inclinedly all around relative to the table, wherein the crown has main facets which extend substantially from the table as far as a girdle, at which the gemstone is of the largest transverse dimension and wherein adjoining the girdle below same is a pavilion comprising preferably pointedly converging facets, and wherein the gemstone consists preferably entirely of topaz.

To improve brilliance and other optical properties of a faceted cut gemstone, in the course of time a wide range of different kinds of cuts have been developed, which differ on the one hand by the number of facets and on the other hand by the mutual geometrical positional relationships of the facets.

For diamonds the so-called brilliant cut has proven to be particularly esthetic, as that provides that the so-called "fire" of the diamond is particularly pronounced and a high light return is achieved. The fire and the light return are based on numerous internal light reflections. Those light reflections are produced at the individual facets which are in specific angular relationships with each other, that characterize the respective cut. The cut and the material of a gemstone are thus crucial for the fire and light return produced.

Further characteristic parameters for the esthetics of a gemstone, that are dependent on the respective cut, are scintillation which describes the sparkle of a moving gemstone, and brilliance which describes the brightness and contrast of the light issuing from a gemstone.

The value of light return specifies how much light incident on the gemstone from a predefined solid angle range goes back to the viewer in a relatively narrow (for example aperture angle 3°) directed solid angle range substantially along the axis of symmetry of the stone.

The fire in turn serves to evaluate the brilliance of a gemstone and denotes its property of breaking the incident white light into its spectral components. The pronouncement of this property is dependent both on the material (dispersion) and also on the cut.

Having regard to the foregoing parameters EP 2 436 281 discloses a gemstone of zirconia with a brilliant cut, which particularly well imitates in regard to those parameters, a diamond (brilliant) cut in a brilliant cut.

A gemstone having a chaton cut has a crown, also referred to as the upper part, with a defined number of side facets and a middle flat table, as well as a pavilion, also referred to as the lower part, with a defined number of facets. The end of the gemstone remote from the table can be in the form of a point or in the form of a rounded point in the form of a so-called culet. A so-called girdle (peripheral edge) can be arranged between the upper and lower parts. The gemstone can be cut symmetrically or asymmetrically.

The object of the invention is to further improve the esthetic impression of a gemstone which consists predominantly or entirely of topaz and which has a chaton cut, by optimization of optical parameters, in particular fire and light return, and to provide an inexpensive alternative to diamond jewelry.

That is attained by a gemstone having the features of claim 1.

The gemstone according to the invention which preferably consists entirely of topaz has a chaton cut in which there adjoins a flat table a crown having main facets which extend substantially from the table to a girdle. By the main facets being arranged at an angle of between 32.5° and 34.5° relative to a plane arranged parallel to the table plane, a particularly high light return with at the same time a high level of fire has surprisingly been achieved. In that case scintillation and brilliance of the gemstone are particularly good.

The plane which is parallel to the table and with respect to which the main facets are inclined towards the plane of the table in the angular range according to the invention is a notional cross-sectional surface through the girdle (girdle plane), in which the gemstone is of the largest transverse dimension. In that case the girdle plane is oriented perpendicularly to the longitudinal direction of the gemstone.

By virtue of the refractive index of natural topaz, which is between 1.62 and 1.64 and generally at 1.63, the advantages of the new cut are particularly well enjoyed in relation to gemstones of that material.

The light return and fire can be measured by means of standardized measuring methods. A possible measuring method is described in greater detail with reference to FIGS. 5 and 6.

Instead of an actual measurement the values in respect of light return and fire can also be simulated by calculation on the basis of the geometry and material of the gemstone.

Further advantageous embodiments of the invention are defined in the appendant claims.

It has been found that preferred angular ranges for the main facets of the crown in relation to a cross-sectional plane parallel to the table, that is to say the girdle plane, are between 33.0° and 34.0°, preferably being 33.5°.

In a preferred embodiment the pavilion comprises three different kinds of facets. The main facets of the pavilion extend from the girdle furthest in the direction of the opposite end of the pavilion, which can converge to a point.

It has been found that the fire and light return in the case of a gemstone according to the invention achieve particularly high values if the angle of the main facets of the pavilion with respect to a cross-sectional plane parallel to the table is between 45° and 47°, preferably between 45.5° and 46.5°. An angle of 46° is quite particularly preferred.

Besides the main facets and the table the crown of the gemstone, which is also referred to as the upper part, has two further kinds of facets. A first kind of crown facets is given by eight crown facets which each with a respective wide side adjoin the table. In an embodiment of the invention those crown facets are at an angle relative to the girdle plane of between 19.5° and 21.5°, preferably between 20° and 21° and quite preferably being 20.5°.

In addition the crown has sixteen further crown facets which respectively adjoin the girdle with the wide side thereof. In an embodiment of the invention the angle between those crown facets and the girdle plane is between 39° and 41°, preferably between 39.5° and 40.5° and is quite preferably 40°.

The pavilion which is also known as the lower part, besides the main facets, has 16 further pavilion facets, wherein eight of those facets are brought to a point or a culet at the end opposite the table while eight further pavilion facets between the main facets adjoin the girdle with a wide side. The end of that pavilion facet, that is opposite to the wide side, converges to a point and is directed away from the girdle. Those pavilion facets adjoining the girdle with the wide side thereof are at an angle relative to the girdle plane, in an embodiment, of between 48° and 50°, preferably between 48.5° and 49.5° and are quite preferably at 49°.

In an embodiment of the invention the angle between the girdle plane and those pavilion facets which constitute the point or are arranged around the point is between 38° and 40.5°, preferably between 38.5° and 39.5° and is quite preferably 39°.

Particularly advantageous values for light return and fire are afforded if the overall height of the gemstone is between 66% and 70%, preferably 68%, of the largest transverse dimension. In that case the overall height corresponds to the distance from the end of the pavilion along the longitudinal axis to the table of the crown. The largest transverse dimension of the gemstone is in the girdle plane. For the case of a girdle which is circular in plan view the largest transverse dimension represents the diameter of that circle.

The height of the pavilion is constituted by the distance between the girdle and the end of the pavilion, that is remote from the table, measured along the longitudinal axis of the gemstone. A particularly impressive fire and a particularly high light return are afforded when the height of the pavilion is between 46% and 50%, preferably 48%, of the largest transverse dimension of the gemstone.

In this connection it has further proven to be advantageous if the height of the crown which extends from the table to the girdle and is measured along the longitudinal axis of the gemstone is between 12% and 16%, preferably being 14%, of the largest transverse dimension of the gemstone.

In a preferred embodiment the girdle is in the form of a narrow peripheral edge. The girdle however can also be in the form of a sharp edge between crown and pavilion.

It has equally been found desirable for fire and light return if the mean diameter of the table is between 51% and 55%, preferably being 53%, of the largest transverse dimension of the gemstone.

Figure 1B:
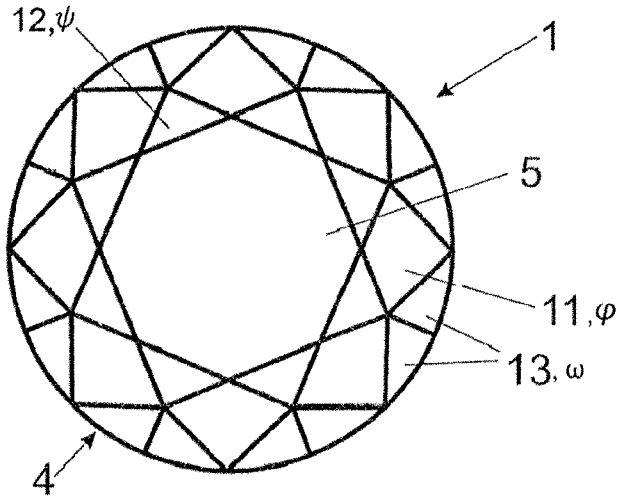
Figure 1C:
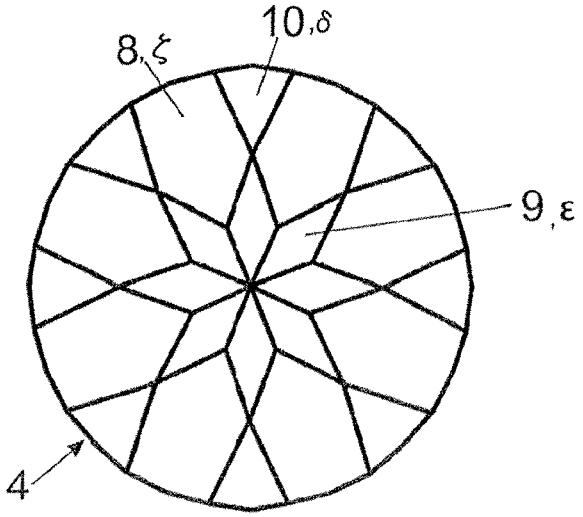
Figure 2A:
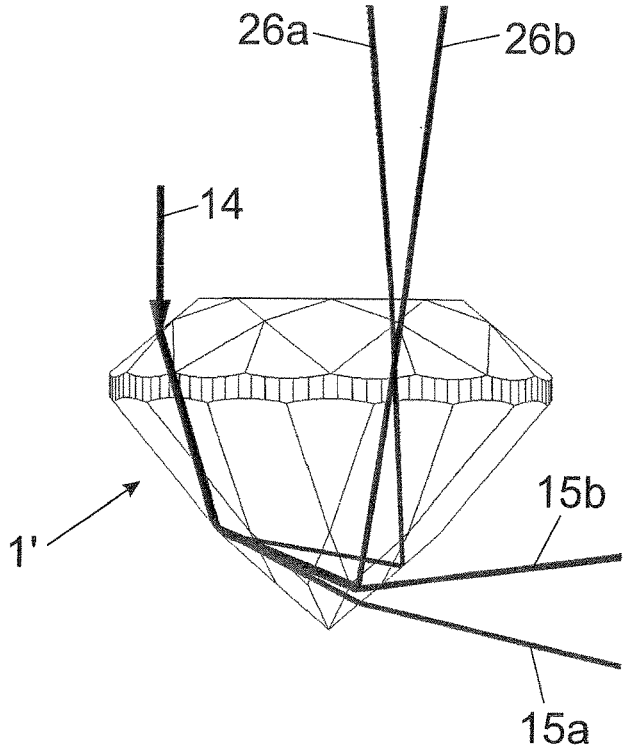
Figure 2B:
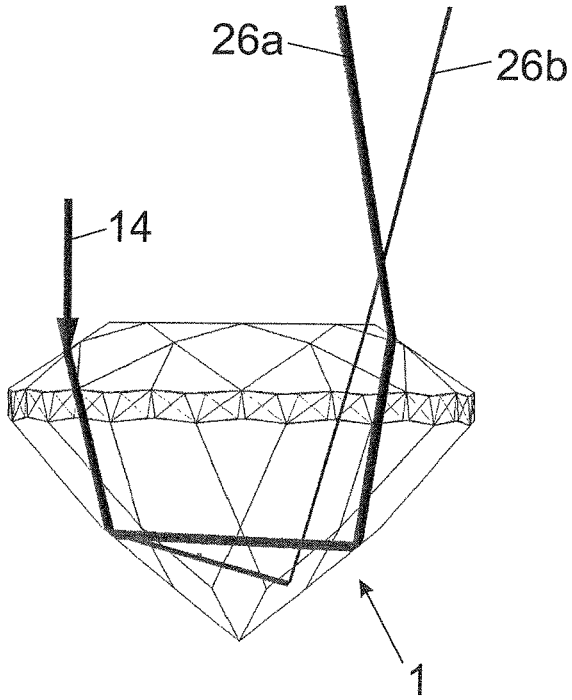
Figure 3A:
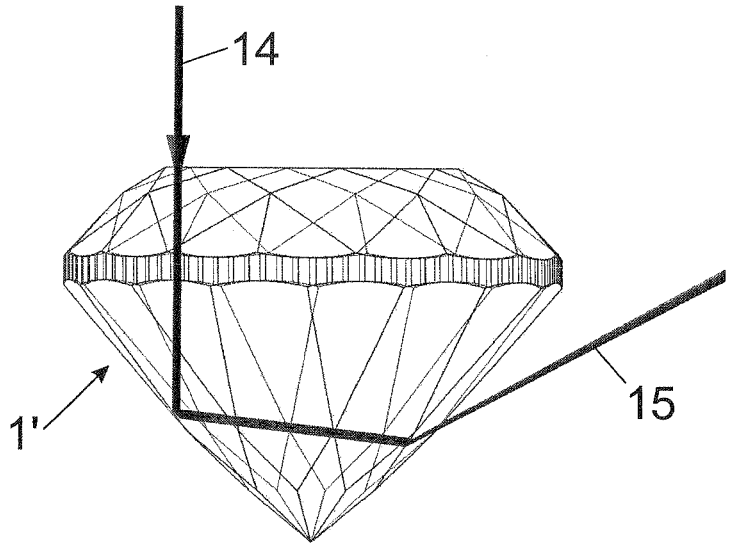
Figure 3B:
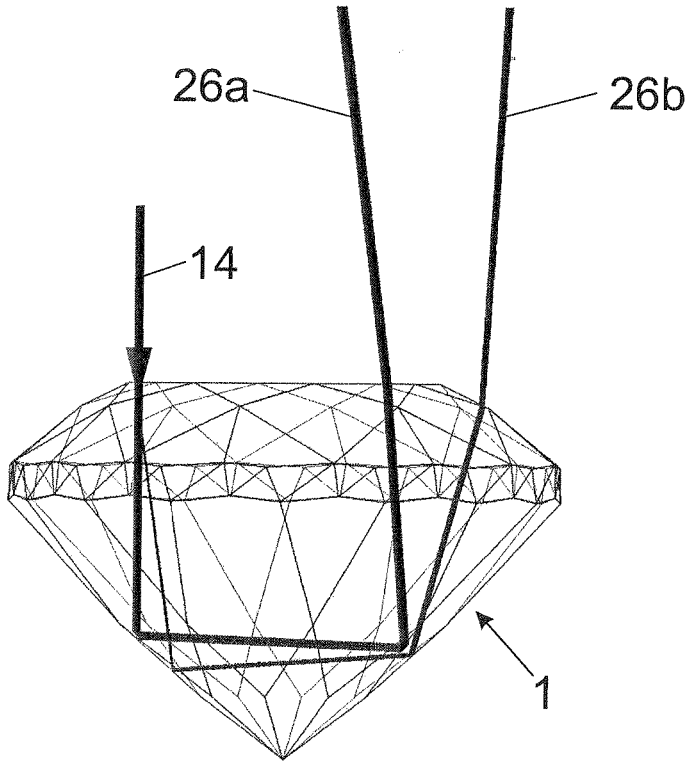
Figure 4A:
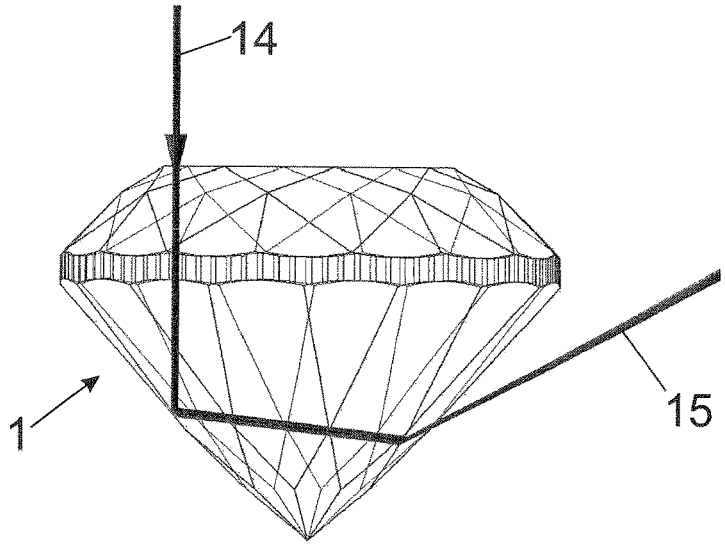
Figure 4B:
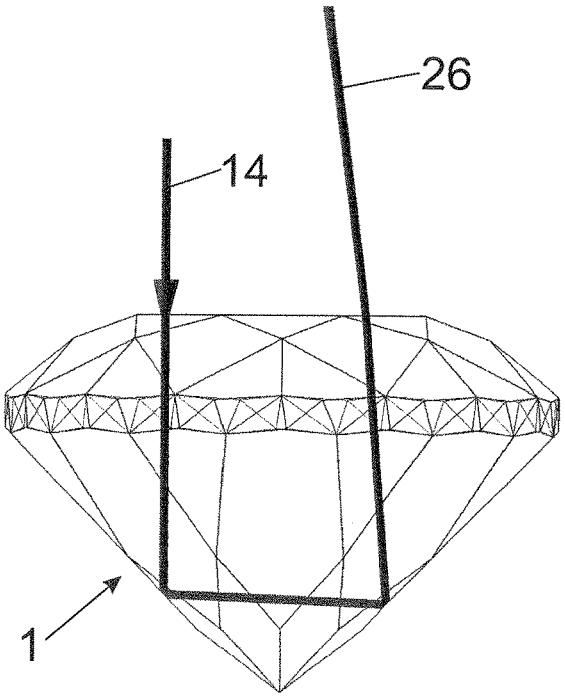
Figure 5:
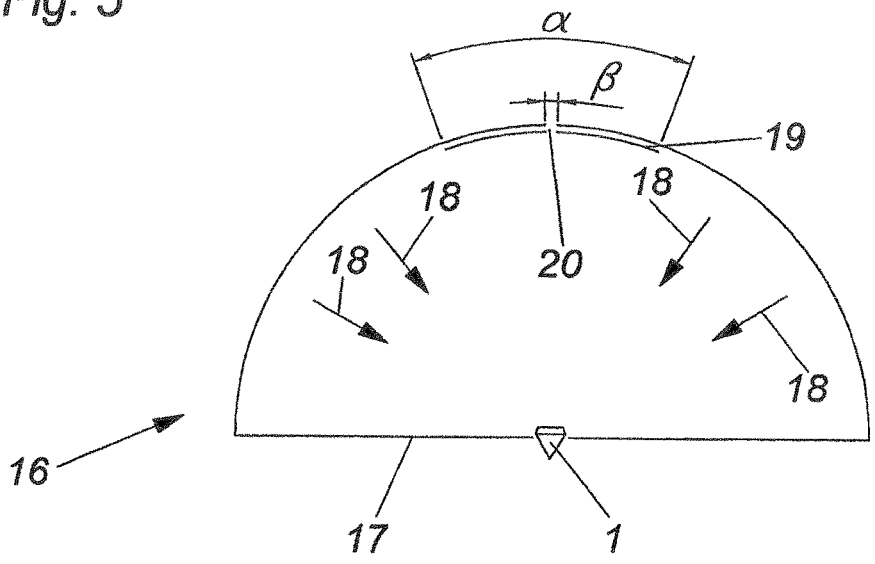
Figure 6:
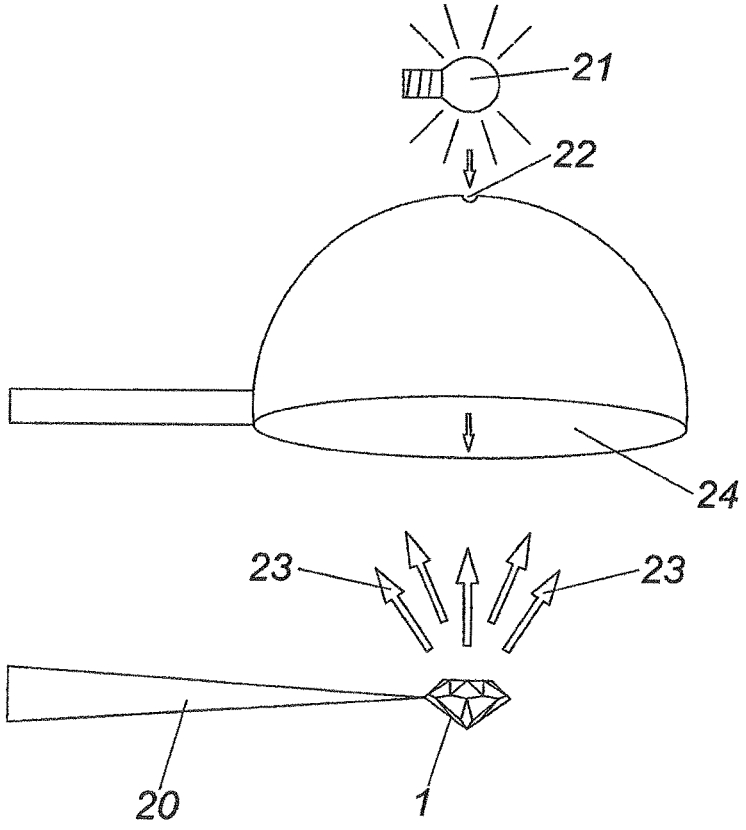
Figure 7:
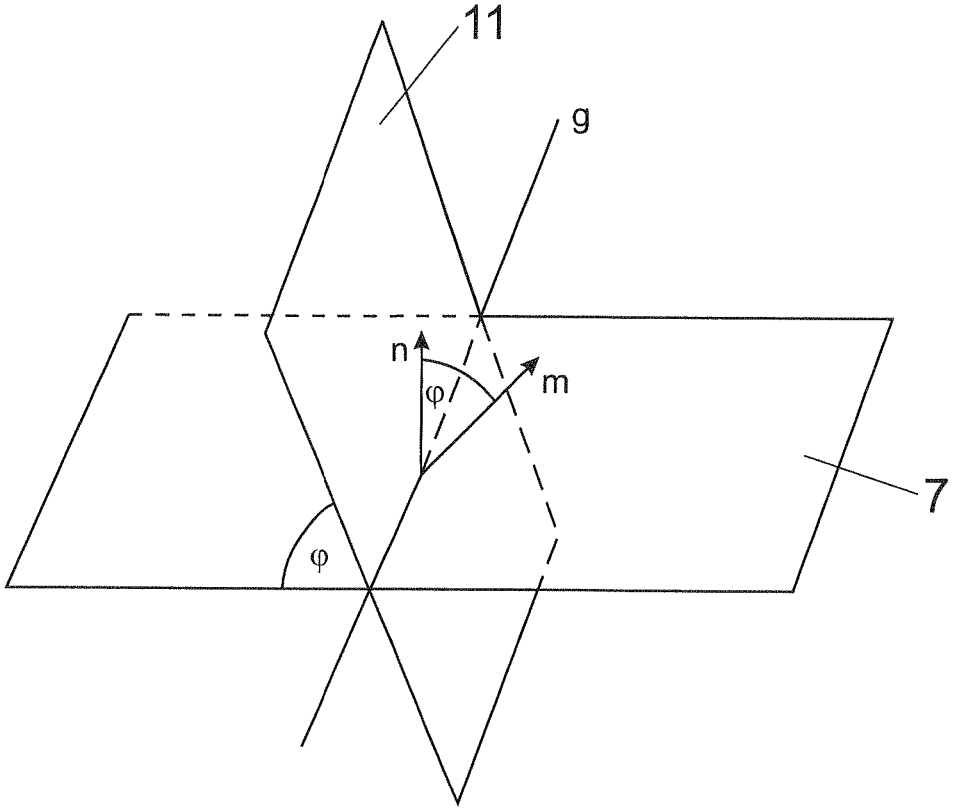

Further details and advantages of the present invention will be described more fully hereinafter by means of the description of the figures with reference to the drawings in which:

FIGS. 1*a* through 1*c* show a side view, a plan view and a view from below of a gemstone according to the invention, FIGS. 2*a* and 2*b* show a comparison of a gemstone in the state of the art with a gemstone according to the invention by a diagrammatic view of beam paths, FIGS. 3*a* and 3*b* show a further comparison of a gemstone in the state of the art with a gemstone according to the invention by a diagrammatic view of beam paths, FIGS. 4*a* and 4*b* show a further comparison of a gemstone in the state of the art with a gemstone according to the invention by a diagrammatic view of beam paths, FIG. 5 shows a diagrammatic view of the measuring arrangement for measuring the "light return", FIG. 6 shows a diagrammatic view of the measuring arrangement for measuring the "fire", and FIG. 7 shows a diagrammatic view of the angle between a facet and a plane parallel to the table.

FIG. 1*a* shows a side view of a gemstone 1 according to the invention. The Figure shows the girdle 4 which separates the crown 2, also referred to as the upper part, from the pavilion 3, also referred to as the lower part. The girdle 4 is the region of the largest transverse dimension of the gemstone 1. The Figure also diagrammatically shows the axis of symmetry (longitudinal axis L) of the gemstone.

The crown 2 has three different kinds of facets 11, 12, 13, wherein the main facets 11 extend from the table 5 to the girdle 4 and are lozenge-shaped. This embodiment of the gemstone 1 has eight such main facets 11. Eight further facets 12 adjoin with a wide side the flat table 5 which is oriented parallel to the girdle plane 7 and perpendicularly to the longitudinal axis L of the gemstone 1. Sixteen further crown facets 13 adjoin with a wide side the girdle 4. The facets 12 and 13 are each of a triangular configuration.

The pavilion 3 also has three different kinds of facets 8, 9, 10, wherein two of those pavilion facets 8, 10 have a wide side adjoining the girdle 4. Those of those facets 8 which extend furthest in the direction of the end 6 of the gemstone 1, that is opposite the table 5, form the main facets 8 of the pavilion 3. The triangular facets 10 adjoin with a wide side the girdle 4, between those main facets 8.

The pavilion 3 converges to a point 6, the point 6 being formed by an arrangement of 8 further pavilion facets 9. Those pavilion facets 9 are of a lozenge-shaped configuration.

FIG. 1*b* shows a plan view of the crown 2 of the gemstone 1. The longitudinal axis L of the gemstone 1 extends through the center of the crown and is oriented perpendicularly to the flat table 5 and the girdle plane 7 which is parallel thereto.

FIG. 1*c* shows a view from below of the pavilion 3 of the gemstone 1. The longitudinal axis L extends at the point 6 provided by the mutually adjoining pavilion facets 9.

FIG. 2*a* shows a gemstone 1' of topaz with a cut according to the state of the art. The light beams 14 passing into the gemstone 1' centrally in the main facet are reflected back only in part in the viewing direction at the pavilion 3' by virtue of the angle at which the pavilion facets and the crown facets are cut, in particular because of the angle of the main facets of the crown. A proportion of the beams is scattered or refracted away to the side in the form of the beams 15*a*, 15*b*. The beams 26*a*, 26*b* which are reflected back in the viewing direction and therewith the light return are correspondingly reduced by the proportion of those beams.

FIG. 2*b* shows the same view for a gemstone 1 according to the invention, wherein the light beams 14 again pass centrally into the gemstone 1 at the main facet 11. By virtue of the special geometrical arrangement of the various facets and in particular the main facets 11 of the crown 2 the light return is markedly improved as the majority of the beams undergoes total internal reflection in the region of the pavilion 3 so that almost the entire amount of light beams 14 passing into the crown 2 is reflected back to the viewer, after possibly multiple reflection, in the form of light beams 26*a*, 26*b* issuing from the crown 2.

The advantages of the angular arrangement of the further crown facets and the pavilion facets, that is set forth in the appendant claims, is shown in FIGS. 3*a* and 3*b* which also show a comparison of a gemstone 1 according to the invention to a gemstone 1' according to the state of the art. In this example the light beams 14 pass into the gemstone 1 and 1' respectively in the facets 10 of the crown 2 of the gemstone. In the case of the gemstone 1' in the state of the art once again a proportion in the form of the light beams 15 is refracted out of the gemstone 1' so that there is a reduction in the light return in the form of the light beams reflected back in the viewing direction.

In comparison therewith in the gemstone 1 the majority of the beams undergoes total internal reflection in the region of the pavilion 3 so that almost the entire proportion of light beams 13 passing into the crown 2 is reflected back to the viewer, after possible multiple reflection, in the form of light beams 26*a*, 26*b* issuing from the crown.

FIGS. 4*a* and 4*b* which once again show a comparison of a gemstone 1' according to the state of the art to a gemstone 1 according to the invention particularly clearly show the effect of the arrangement of the pavilion facets. In these Figures the light beams 14 enter directly at the table 5. Once again, in the gemstone 1' according to the state of the art, a part of the light beams 15 issues at the pavilion 3 while in the gemstone 1 according to the invention almost the majority of the beams 26 is reflected back in the viewing direction.

FIG. 5 is a diagrammatic view showing a measuring arrangement for measuring the light return of a gemstone. A hemispherical illumination arrangement 16 is used to illuminate a gemstone 1 arranged at the center of the base circle 17 of the hemisphere 16, with light beams 18, so that the crown 2 of the gemstone 1 is irradiated with white diffuse light, wherein the light beams are incident except for a darkened region 19 in a hemispherical configuration on the gemstone 1 and are reflected thereby. The base circle 17 is darkened except for an opening for the gemstone 1 so that no light is incident on the gemstone 1 from below the base circle 17. A region 19 of the hemisphere 16 which is precisely opposite the gemstone 1 and has an aperture angle $\alpha$ of 46 degrees is also darkened. There is also no light going to the gemstone 1 from that region. The region 19 has an opening 20 with an aperture angle $\beta$ of 3 degrees. That opening 20 serves as a narrow measuring field for a detector. Thus a light flux-measuring detector can be arranged above the opening 20.

Instead of physical measurement, the respective light-specific values like for example the brightness in the region of that opening 20 can be calculated in a computer simulation.

The amount of light reflected upwardly by the gemstone 1 represents a mean value over almost all possible illumination arrangements and thus gives a quantitative measurement in respect of the light return of the gemstone 1. In that case the reflections take place at various facets so that light is reflected back to the opening directly upon being first incident on the gemstone, but also after one of a plurality of internal reflections.

FIG. 6 shows a measuring arrangement for the "fire" value. The gemstone 1 which is held by a holder 20 is lit in the direction of its main axis with a directed light from the light source 21 through the opening 22. The light which is back-scattered by the gemstone 1 is recorded in color on a measuring field 24. The product values of saturation and illumination intensity of the light points detected in the measuring field (25) are totaled and thus give the numerical value in respect of the "fire".

FIG. 7 diagrammatically shows the inclined arrangement of the main facet 11 of the upper part 2 in relation to a cross-sectional surface 7 which is arranged parallel to the table 5 and which for example corresponds to the girdle plane. For the sake of improved clarity of the drawing the facet 11 is shown in the form of a plane. This also applies to the cross-sectional surface 7. The angle $\phi$ between the planes is also adopted between the associated normal vectors n and m. The straight line g represents the intersection line between the planes 11 and 7.

The invention claimed is:

1. A gemstone, comprising:

a crown having a flat table and facets being arranged all the way around the table and being inclined relative to the table;

a girdle at which the gemstone has a largest transverse dimension; and a pavilion adjoining the girdle from below the girdle, the pavilion having facets, wherein the facets of the crown include:

a set of eight main crown facets which extend substantially from the table to as far as the girdle, the main crown facets being inclined with respect to a girdle plane at an angle between 32.5° and 34.5°, redirecting a proportion of light beams from being scattered or directed away to a side, a set of eight second crown facets, each second crown facet having a broad side which adjoins the table, and a set of sixteen third crown facets, each third crown facet having a broad side which adjoins the girdle, wherein the facets of the pavilion include:

a set of eight main pavilion facets, each main pavilion facet adjoining the girdle, wherein an angle of the main pavilion facets with respect to a girdle plane is between 45° and 47° such that the majority of the beams undergoes total internal reflection in the region of the pavilion, a set of eight second pavilion facets, each second pavilion facet having a broad side which adjoins the girdle, and a set of eight third pavilion facets which form a point or a rounded point, wherein the main pavilion facets extend farther toward the point than the second pavilion facets, wherein the gemstone consists of topaz, and wherein all of the main crown facets are substantially identical in shape and all of the main pavilion facets are substantially identical in shape.

2. The gemstone as set forth in claim 1, wherein an angle of the main crown facets is between 33.0° and 34.0°.

3. The gemstone as set forth in claim 2, wherein the angle of the main crown facets is 33.5°.

4. The gemstone as set forth in claim 3, wherein the angle of the main pavilion facets is between 45.5° and 46.5°.

5. The gemstone as set forth in claim 4, wherein the angle of the main pavilion facets is 46°.

6. The gemstone as set forth in claim 2, wherein the angle of the main pavilion facets is between 45.5° and 46.5°.

7. The gemstone as set forth in claim 6, wherein the angle of the main pavilion facets is 46°.

8. The gemstone as set forth in claim 2, wherein an angle between a girdle plane and the second crown facets is between 19.5° and 21.5°, or an angle between the girdle plane and the third crown facets is between 39° and 41°.

9. The gemstone as set forth in claim 8, wherein the angle between the girdle plane and the second crown facets is between 20° and 21°.

10. The gemstone as set forth in claim 8, wherein the angle between the girdle plane and the third crown facets is between 39.5° and 40.5°.

11. The gemstone as set forth in claim 1, wherein the angle of the main pavilion facets is between 45.5° and 46.5°.

12. The gemstone as set forth in claim 11, wherein the angle of the main pavilion facets is 46°.

13. The gemstone as set forth in claim 1, wherein an angle between a girdle plane and the second crown facets is between 19.5° and 21.5°, or an angle between the girdle plane and the third crown facets is between 39° and 41°.

14. The gemstone as set forth in claim 13, wherein the angle between the girdle plane and the second crown facets is between 20° and 21°.

15. The gemstone as set forth in claim 13, wherein the angle between the girdle plane and the third crown facets is between 39.5° and 40.5°.

16. The gemstone as set forth in claim 1, wherein an angle between a girdle plane and the third pavilion facets is between 38.0° and 40.5°.

17. The gemstone as set forth in claim 16, wherein the angle between the girdle plane and the third pavilion facets is between 38.5° and 39.5°.

18. The gemstone as set forth in claim 1, wherein an angle between a girdle plane and the second pavilion facets is between 48° and 50°.

19. The gemstone as set forth in claim 18, wherein the angle between the girdle plane and the second pavilion facets is between 48.5° and 49.5°.

20. The gemstone as set forth in claim 1, wherein an overall height of the gemstone is between 66% and 70% of a height of the girdle.

21. The gemstone as set forth in claim 1, wherein a height of the pavilion is between 46% and 50% of a height of the girdle.

22. The gemstone as set forth in claim 1, wherein a height of the crown is between 12% and 16% of a height of the girdle.

23. The gemstone as set forth in claim 1, wherein a mean diameter of the table is between 51% and 55% of a mean diameter of the girdle.

24. A gemstone, comprising:

a crown having a flat table and facets being arranged all the way around the table and being inclined relative to the table;

a girdle at which the gemstone has a largest transverse dimension; and a pavilion adjoining the girdle from below the girdle, the pavilion having facets, wherein the facets of the crown include:

a set of eight main crown facets which extend substantially from the table to as far as the girdle, a set of eight second crown facets, each second crown facet having a broad side which adjoins the table, and a set of sixteen third crown facets, each third crown facet having a broad side which adjoins the girdle, wherein the facets of the pavilion include:

a set of eight main pavilion facets, each main pavilion facet adjoining the girdle, a set of eight second pavilion facets, each second pavilion facet having a broad side which adjoins the girdle, and a set of eight third pavilion facets which form a point or a rounded point, wherein the main pavilion facets extend farther toward the point or the rounded point than do the second pavilion facets, the main pavilion facets being inclined with respect to a girdle plane at an angle between 45° and 47° such that the majority of the beams undergoes total internal reflection in the region of the pavilion and the third pavilion facets being inclined with respect to the girdle plane at an angle between 38.0° and 40.5°, wherein the gemstone consists of topaz, and wherein all of the main crown facets are substantially identical in shape and all of the main pavilion facets are substantially identical in shape.

25. The gemstone as set forth in claim 24, wherein an angle of the main crown facets is between 33.0° and 34.0°.

26. The gemstone as set forth in claim 24, wherein an angle between a girdle plane and the second crown facets is between 19.5° and 21.5°.

27. The gemstone as set forth in claim 24, wherein an angle between the girdle plane and the third crown facets is between 39° and 41°.

28. The gemstone as set forth in claim 24, wherein an angle between a girdle plane and the second pavilion facets is between 48° and 50°.

29. The gemstone as set forth in claim 24, wherein an overall height of the gemstone is between 66% and 70% of a height of the girdle.

30. The gemstone as set forth in claim 24, wherein a height of the pavilion is between 46% and 50% of a height of the girdle.

31. The gemstone as set forth in claim 24, wherein a height of the crown is between 12% and 16% of a height of the girdle.

32. The gemstone as set forth in claim 24, wherein a mean diameter of the table is between 51% and 55% of a mean diameter of the girdle.

33. The gemstone as set forth in claim 1, wherein each of the main crown facets adjoins the table at a point.

34. The gemstone as set forth in claim 1, wherein each of the third pavilion facets adjoins one of the second pavilion facets at a point.

35. The gemstone as set forth in claim 24, wherein each of the main crown facets adjoins the table at a point.

36. The gemstone as set forth in claim 24, wherein each of the third pavilion facets adjoins one of the second pavilion facets at a point.

* * * * *